United States Patent [19]

Bradley et al.

[11] Patent Number: 4,875,524

[45] Date of Patent: Oct. 24, 1989

[54] CASING CENTRALIZER

[75] Inventors: Billie J. Bradley; Richard L. Giroux; Allen T. Joyce, all of Duncan, Okla.

[73] Assignee: Halliburton Company, Duncan, Okla.

[21] Appl. No.: 250,900

[22] Filed: Sep. 29, 1988

[51] Int. Cl.[4] ..... E21B 17/10

[52] U.S. Cl. ..... 166/241

[58] Field of Search ..... 166/241, 172; 175/325

[56] References Cited

U.S. PATENT DOCUMENTS

| | | | |
|---|---|---|---|
| 2,248,160 | 7/1941 | Crawford | 166/241 X |
| 2,874,783 | 2/1959 | Haines | 166/241 X |
| 3,055,432 | 9/1962 | Park | 166/241 |
| 3,556,042 | 1/1971 | Laughlin | 166/241 |
| 4,011,907 | 3/1977 | Clay | 166/241 |
| 4,219,081 | 8/1980 | Howe | 166/241 |

*Primary Examiner*—Hoang C. Dang

*Attorney, Agent, or Firm*—James R. Duzan

[57] ABSTRACT

A semi-rigid floating spring type centralizer for use in deviated, highly deviated or horizontal well bores, the centralizer comprising a cylindrical tubular housing having a plurality of floating centralizer springs retained thereon.

7 Claims, 1 Drawing Sheet

CASING CENTRALIZER

BACKGROUND OF THE INVENTION

This invention relates to a centralizer for use in deviated, highly deviated or horizontal well bores to center the casing in the well bore during cementing of the casing in the well bore. More specifically, the invention relates to a semi-rigid floating spring type centralizer for use in deviated, highly deviated or horizontal well bores to center the casing in the well bore during cementing of the casing in the well bore.

Typically prior art centralizers can be generally classified as fixed spring types, floating spring types, rigid types and combinations thereof. There are also various types of knock-down centralizers which may be fixed spring, floating spring, rigid or combination type centralizers.

In deviated, highly deviated or horizontal well bores it is desirable, in order to obtain better results in the cementing of the casing in the well bore, to have the casing in the or near the center of the well bore during cementing operations. If fixed spring and floating spring type centralizers are used, they will need to have high spring forces generated by the springs to ensure that the casing is centered in the well bore. However, these types of centralizers will need to be installed about the casing and held in position by either the casing collars or limit clamps installed on the casing. Since the casing collars and limit clamps will prevent the springs on the centralizers from fully deflecting during running of the casing in the well bore, high starting forces to start the centralizers into the well bore and high running forces to run and reciprocate the casing in the well bore will be present. If rigid type centralizers are used to center the casing in the well bore during cementing operations, the centralizer will be of smaller diameter than the well bore since it is rigid and contains no springs and will merely attempt to maintain a minimum distance between the casing and the well bore during cementing operations.

Combination types of rigid and floating spring type centralizers such as shown in U.S. Pat. Nos. 2,636,564 and 2,728,399 are an attempt to utilize the best features of both types of centralizers. However, since the springs are of a limited number the restoring force may not be sufficient to center the casing in the well bore or due to limited movement of the springs the starting and running forces generated by the centralizer may be high.

BRIEF STATEMENT OF THE INVENTION

The present invention relates to a semi-rigid floating spring type centralizer for use in deviated, highly deviated or horizontal well bores. The centralizer of the present invention comprises a cylindrical tubular housing having a plurality of floating centralizer springs retained thereon.

The semi-rigid centralizer of the present invention will be better understood when the drawings are taken in conjunction with the description of the invention.

DESCRIPTION OF THE INVENTION

Figure 1:
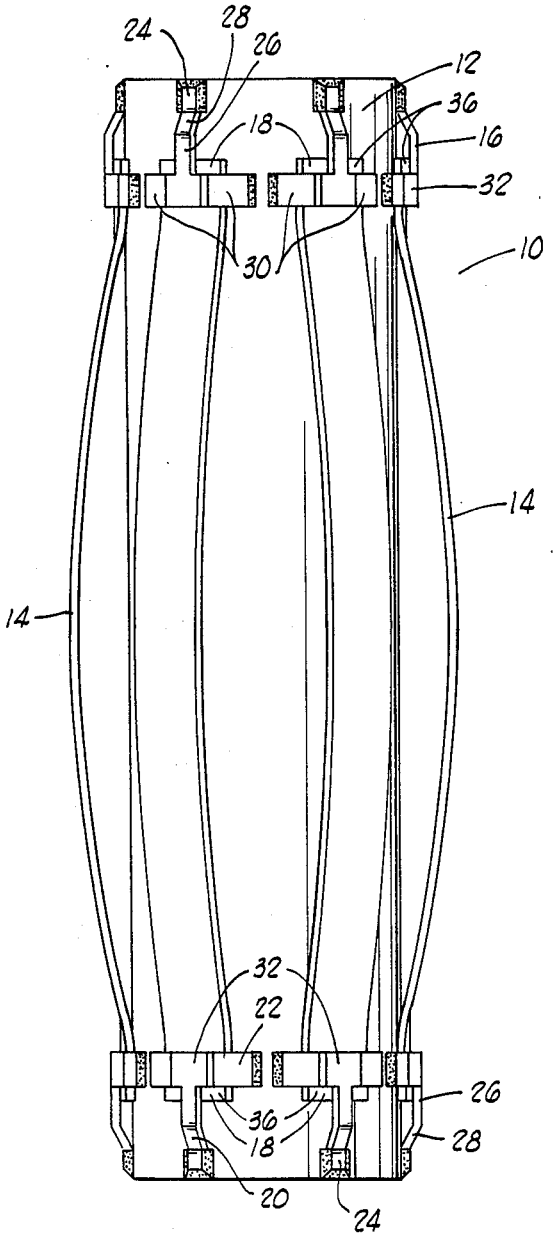
FIG. 1 is a view of the centralizer of the present invention.

Referring to FIG. 1, the semi-rigid centralizer 10 of the present invention is shown.

The centralizer 10 comprises a cylindrical housing 12 having a plurality of free floating springs 14 retained thereon by spring retainers 16.

The cylindrical housing 12 comprises an annular elongated cylindrical member which is formed having a diameter slightly larger than the diameter of the casing on which it is to be installed. The cylindrical housing 12 may be formed as a one-piece tubular member, a hinged member or multi-segmented member secured by fasteners to form a cylindrical housing.

Each spring 14 of the plurality of springs 14 on the centralizer comprises an elongated bow-shaped resilient member having a rectangular cross-section with each end 18 of each resilient member being configured in a "T" shape to engage the spring retainer 16 in which it is retained in a fixed but free floating arrangement. If desired, any cross-sectional shaped of material may be used for each spring 14.

Each spring retainer 16 secured to the cylindrical housing 12 comprises a "T" shaped member having a stem portion 20 and a crossbar portion 22. The stem portion 20 is formed having a housing portion 24 secured to the cylindrical housing 12 and an elevated portion 26 secured to the crossbar portion 22 and secured to the housing portion by intermediate portion 28. The crossbar portion 22 is formed having arcuate housing portions 30 secured to the cylindrical housing 12 and elevated spring retention portion 32 which overlies a portion of the end portion 18 of a spring 14 and is attached to the elevated portion 26 of the stem portion 20.

Each spring retainer 16 may be secured to the cylindrical housing 12 by any suitable means, such as welding, as shown, threaded fasteners, rivets, etc. As shown, the outer ends of arcuate housing portions 30 of each spring retainer 16 are welded to the cylindrical housing 12 while the housing portion 24 of the stem portion 20 is also welded to the cylindrical housing 12. The elevated portions 28 of each spring retainer 16 help to guide the centralizer 10 in the well bore when the centralizer 10 is being run into the well bore on casing. If desired, the spring retainer 16 may be formed integrally with the housing 12 through suitable metal forming operations.

Figure 2:
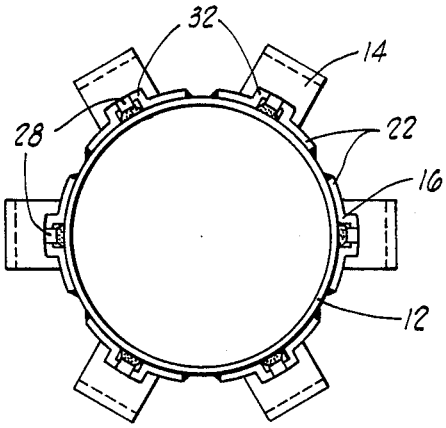
FIG. 2 is an end view of the centralizer of the present invention

Referring to FIG. 2, the semi-rigid centralizer 10 of the present invention is show in an end-view.

As shown, the arcuate housing portions 30 of crossbar portion 22 of the spring retainers 16 are secured to the cylindrical housing 12 as well as housing portion 24 of stem portion 20 of each spring retainer 16.

Also shown in dotted lines in FIG. 2 is the rectangular cross-section of each spring 14.

Figure 3:
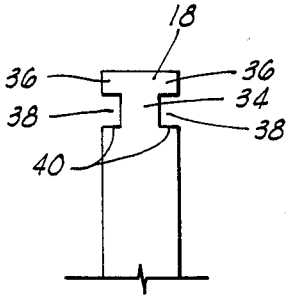
FIG. 3 is a view of the end portion of a centralizer spring of the present invention.

Referring to FIG. 3, the end portion 18 of each spring 14 is shown as a "T" shaped member. The end portion 18 is formed having a stem portion 34 and crossbar portions 36 formed by notches or cut-outs 38 in each end of spring 14.

When secured to the centralizer 10, the elevated spring retention portion 32 of spring retainer 16 overlies the stem portion of 34 of end portion 18 of spring 14 while crossbar portions 36 extend beyond arcuate housing portions 30 of spring retainers 16. Upon deflection of the spring 14, shoulders 40 of the spring may abut the arcuate portions 30 of spring retainers 16 to prevent further movement of the spring 14 with respect to the spring retainer 16.

OPERATION OF THE INVENTION

Referring to FIGS. 1 through 3, to install the semi-rigid centralizer 10 of the present invention on casing being run into a well bore, the centralizer 10 is installed between casing couplings and allowed to slide therebetween or may be prevented from substantial sliding on the casing between casing couplings by a limit clamp installed on the casing.

When running casing into the well bore with the semi-rigid centralizer 10 installed thereon, since each end 18 of each spring 14 is free to move independently of the cylindrical housing 12, the initial force required to deflect each spring 14 is reduced upon starting of the centralizer into the well bore as well as the running force required to run the casing with centralizers thereon in the well bore.

When the springs 14 have deflected a predetermined amount, shoulders 40 abut the arcuate portions 30 of spring retainers 16 and any further spring deflection of spring 14 requires a much greater force to be placed on the spring 14 as the end portions 18 of the spring 14 are fixed and cannot move with respect to the cylindrical housing 12.

Since the cylindrical housing 12 of the semi-rigid centralizer 10 loosely fits about the casing on which it is installed, the casing may be rotated or reciprocated in a normal manner during well cementing operations.

Also, when the semi-rigid centralizer 10 is run into the well bore on casing the upper most casing coupling or limit clamp will transmit downward force to the cylindrical housing 12 which, in turn, transmits the force to the lower most spring retainers 16 on the housing 12 which, in turn, transmits the downward force to the end portions 18 of the springs 16 to pull the centralizer into the well bore thereby lowering the starting force to start the centralizer 10 in the well bore and the running force of the centralizer 10 in the well bore. When the casing is moved upwardly in the well bore, the process is reversed with the application of the force on the semi-rigid centralizer 10 being reversed to pull the centralizer 10 from the well.

Having thus described our invention, we claim:

1. A semi-rigid centralizer for use in a well installed on conduit members therein, said centralizer comprising:

a tubular housing having a longitudinal axis and a circumferential direction thereabout installed on a conduit member of said conduit members in said well;

a first plurality of spring retainers secured to the outer portion of a first end portion of the tubular housing, each spring retainer of the first plurality of spring retainers being formed as a T shaped member having a stem portion and a crossbar portion wherein a portion of the stem portion of the T shaped member is secured to the tubular housing substantially in the direction of the longitudinal axis of the tubular housing and wherein portions of the crossbar portion of the T shaped member are secured substantially in a circumferential direction of the housing;

a second plurality of spring retainers secured to the outer portion of another end portion of the tubular housing, each spring retainer of the second plurality of spring retainers being formed as a T shaped member having a stem portion and a crossbar portion wherein a portion of the stem portion of the T shaped member is secured to the tubular housing substantially in the direction of the longitudinal axis of the tubular housing and wherein portions of the crossbar portion of the T shaped member are secured substantially in a circumferential direction of the tubular housing, and a plurality of elongated centralizer spring members, each centralizer spring member of the plurality of elongated centralizer spring members having one end thereof secured by a spring retainer of the first plurality of spring retainers wherein a portion of the stem portion and the crossbar portion of each T shaped member overlying a portion of one end of each centralizer spring and another end thereof secured by a spring retainer of the second plurality of spring retainers wherein a portion of the stem portion and the crossbar portion of each T shaped member overlying a portion of the another end of each centralizer spring.

2. The semi-rigid centralizer of claim 1 wherein each centralizer spring member of the plurality of elongated centralizer spring members has the ends thereof secured in floating, movable relationship to the first plurality of spring retainers and the second plurality of spring retainers.

3. The semi-rigid centralizer of claim 1 wherein: each T shaped spring retainer of the first plurality of spring retainers includes:

a stem portion having a housing portion secured to the tubular housing, an elevated portion secured to the crossbar portion of the T and an intermediate portion connecting the stem portion and the crossbar portion; and a crossbar portion having arcuate housing portions having, in turn, a portion secured to the tubular housing and an elevated spring retention portion overlying a portion of a spring of the plurality of spring members and attached to the elevated portion of the stem portion of the T shaped spring retainer;

and each T shaped spring retainer of the second plurality of spring retainers included:

a stem portion having a housing portion secured to the tubular housing, an elevated portion secured to the crossbar portion of the T and an intermediate portion connecting the stem portion of the crossbar portion; and a crossbar portion having arcuate housing portions having, in turn, a portion secured to the tubular housing and an elevated spring retention portion overlying a portion of a spring of the plurality of spring members and attached to the elevated portion of the outer stem portion of the T shaped spring retainer.

4. The semi-rigid centralizer of claim 1 wherein the tubular housing is longer than the plurality of elongated centralizer spring members.

5. The semi-rigid centralizer of claim 3 wherein:

each elongated centralizer spring member of the plurality of elongated centralizer spring members comprises a bow-shaped elongated, rectangular in cross-section member having a T shape having a crossbar portion and stem portion formed on one end thereof and on the other end thereof a T shape having a crossbar portion and a stem portion.

6. The semi-rigid centralizer of claim 5 wherein:

the stem portion of the T shape on one end of each elongated centralizer spring member of the plurality of elongated centralizer spring member underlies the elevated spring retention portion of the crossbar portion of the T shaped spring retainer of the first plurality of spring retainers and the crossbar portion of the T shape on one end of each elongated centralizer spring member of the first plurality of elongated centralizer member spring members underlies the elevated spring retention portion of the stem portion of the T shaped spring retainer of the first plurality of spring retainers; and the stem portion of the T shape on the other end of each elongated centralizer spring member of the plurality of elongated centralizer spring members underlies the elevated spring retention portion of the crossbar portion of the T shaped spring retainer of the second plurality of spring retainers and the crossbar portion of the T shape on the other end of each elongated centralizer spring member of the second plurality of elongated centralizer spring member underlies the elevated spring retention portion of the stem portion of the T shaped spring retainer of the second plurality of spring retainers.

7. The semi-rigid centralizer of claim 6 wherein:

the length of the stem portion of the T shape on one end of each elongated centralizer spring member of the plurality of elongated centralizer spring member has a length longer by a predetermined amount than the width of the crossbar portion of each T shaped spring retainer of the first plurality of spring retainers to allow each centralizer spring member of the plurality of elongated centralizer spring members of the semi-rigid centralizer to be moved in a first direction upon movement of said centralizer in said well; and the length of the stem portion of the T shape on the other end of each elongated centralizer spring member of the plurality of elongated centralizer spring member has a length longer by a predetermined amount than the width of the crossbar portion of each T shaped spring retainer of the second plurality of spring retainers to allow each centralizer spring member of the plurality of elongated centralizer spring member of the semi-rigid centralizer to be moved in a second direction upon movement of said centralizer in said well.

* * * * *